US008979322B2

(12) United States Patent
Uhler et al.

(10) Patent No.: US 8,979,322 B2
(45) Date of Patent: Mar. 17, 2015

(54) SELF-LOCKING TRIM RING AND CHANNEL FOR OPTIC LENS

(75) Inventors: George Uhler, Wadsworth, OH (US); Timothy Chen, Aurora, OH (US)

(73) Assignee: Technical Consumer Products, Inc., Aurora, OH (US)

( * ) Notice: Subject to any disclaimer, the term of this patent is extended or adjusted under 35 U.S.C. 154(b) by 319 days.

(21) Appl. No.: 13/465,832

(22) Filed: May 7, 2012

(65) Prior Publication Data

US 2013/0294088 A1 Nov. 7, 2013

(51) Int. Cl.

| | |
|---|---|
| ***F21V 5/04*** | (2006.01) |
| ***B21D 53/00*** | (2006.01) |
| ***F21V 17/10*** | (2006.01) |
| ***F21V 29/00*** | (2006.01) |
| ***F21V 19/00*** | (2006.01) |
| ***F21V 17/16*** | (2006.01) |
| ***F21K 99/00*** | (2010.01) |

(52) U.S. Cl.

CPC ..... *F21V 17/16* (2013.01); *B21D 53/00* (2013.01); *F21K 9/137* (2013.01); *F21V 19/00* (2013.01); *F21V 29/00* (2013.01); *F21V 5/04* (2013.01)

USPC ..... 362/311.01; 362/319; 362/376; 362/373; 362/455; 29/890.03

(58) Field of Classification Search

None

See application file for complete search history.

(56) References Cited

U.S. PATENT DOCUMENTS

| | | | | |
|---|---|---|---|---|
| 5,477,441 | A * | 12/1995 | Budnovitch et al. | 362/362 |
| 6,068,384 | A * | 5/2000 | Tyson et al. | 362/153.1 |
| 7,458,330 | B2 * | 12/2008 | MacDonald et al. | 114/177 |
| 8,757,852 | B2 * | 6/2014 | Lopez et al. | 362/382 |

* cited by examiner

*Primary Examiner* — Ashok Patel

(74) *Attorney, Agent, or Firm* — Thompson Hine LLP

(57) ABSTRACT

A lamp comprises an optical lens. The lamp further comprises a self-locking trim ring including a plurality of teeth. The self-locking trim ring is disposed over the optical lens. The lamp further comprises a heat sink. The heat sink has an inner chamber wherein the optical lens is disposed in the inner chamber. The heat sink also has an outer chamber disposed radially outwardly from the inner chamber. The outer chamber has a recess that engages the plurality of teeth. The self-locking trim ring secures the optical lens to the heat sink.

19 Claims, 5 Drawing Sheets

SELF-LOCKING TRIM RING AND CHANNEL FOR OPTIC LENS

FIELD OF DISCLOSURE

The present disclosure relates to the field of lamps. More particularly, the present disclosure relates to a method and apparatus for securing an optical lens to a lamp housing or heat sink.

BACKGROUND

A lamp has, among other components, an optical lens for refracting, reflecting, or otherwise transmitting light. Assembling the lamp requires securing the optical lens to a lamp housing or a heat sink. Existing dry assembly techniques may secure the optical lens to the heat sink using a number of screws. Existing wet assembly may techniques apply an adhesive in a ridge in the heat sink before inserting the screws. The screws provide pressure while the adhesive between the heat sink and the optical lens cures. A decorative finish ring may be added to conceal the adhesive and screws.

Existing assembly techniques, however, may require multiple component parts. Using multiple component parts may result in an increase in cost of manufacturing the lamp as well as an increase in labor time necessary for assembly. Using multiple component parts may also result in increased occurrences of assembly error since additional assembly steps may be required. Furthermore, existing heat sink and lamp assemblies are not easily adaptable for both wet and dry assembly techniques.

SUMMARY OF THE DISCLOSURE

A lamp comprises an optical lens. The lamp further comprises a self-locking trim ring including a plurality of teeth. The self-locking trim ring is disposed over the optical lens. The lamp further comprises a heat sink. The heat sink has an inner chamber wherein the optical lens is disposed in the inner chamber. The heat sink also has an outer chamber disposed radially outwardly from the inner chamber. The outer chamber has a recess that engages the plurality of teeth. The self-locking trim ring secures the optical lens to the heat sink.

A lamp has a self-locking trim ring with a plurality of ridges having flanks. The lamp further has a lens housing. The lens housing has an inner channel configured to support an optical lens. The lens housing also has an outer channel with a recess configured to engage the flanks of the plurality of ridges. The self-locking trim ring is configured to secure the optical lens to the lens housing.

Further, according to another aspect of the present disclosure, a method for securing an optic lens to a heat sink includes the step of inserting an optic lens into an inner chamber of a heat sink. The method further includes the step of aligning a plurality of teeth of a self-locking trim ring with a plurality of cutouts of a recess in an outer chamber of the heat sink. The method further includes the step of inserting the teeth into a groove in the outer chamber, via the cutouts. The method further includes the step of rotating the self-locking trim ring to engage the recess with the plurality of teeth.

BRIEF DESCRIPTION OF THE DRAWINGS

In the accompanying drawings, structures are illustrated that, together with the detailed description provided below, describe exemplary aspects of the present teachings. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figure 1:
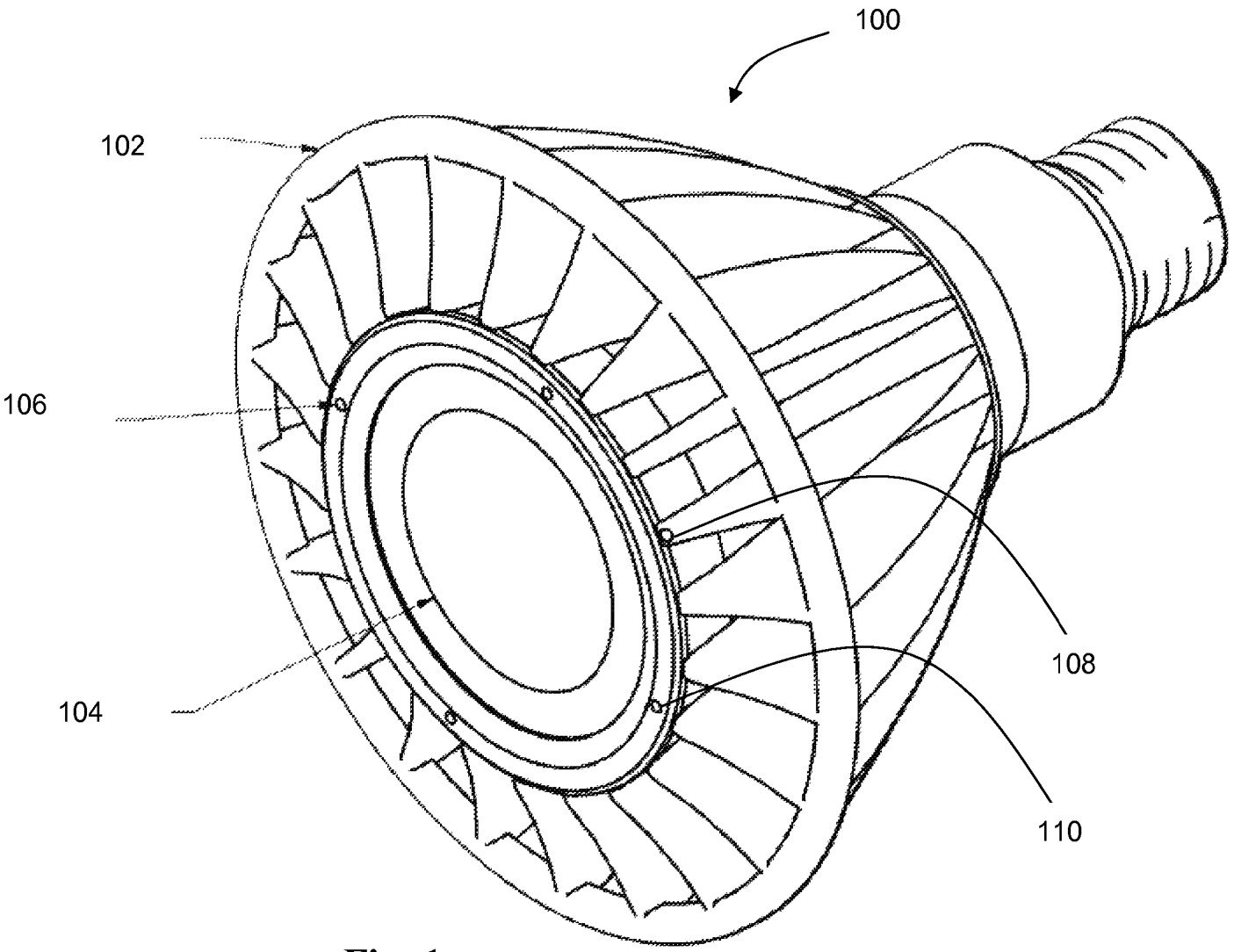
FIG. 1 illustrates a perspective view of an example lamp according to one exemplary aspect of the present teaching.

FIG. 1 illustrates a perspective view of an example lamp 100 according to one exemplary aspect of the present teaching. Lamp 100 comprises a heat sink 102, an optical lens 104, and a self-locking trim ring 106. Self-locking trim ring 106 is configured to secure optical lens 104 to heat sink 102. It should be understood that, although the example aspects of the present disclosure describes optical lens 104 as being secured to heat sink 102 specifically, self-locking trim ring 106 may be used to secure optical lens 104 to a lamp housing or other similar fixture as well.

As shown herein, the illustrated self-locking trim ring 106 is a single part and is configured to secure optical lens 104 to heat sink 102 without the need for additional part. As a result, the assembly time and cost of lamp 100 may be reduced. Similarly, the rate of occurrence of assembly errors may be reduced as well since the number of steps required to assemble lamp 100 may be less than otherwise required. Moreover, self-locking trim ring 106 and heat sink 102 are configured for both dry and wet location applications. This combined functionality may result in cost savings as well since such combined functionality may eliminate the need to manufacture separate lamp components for both dry and wet location applications.

In one aspect of the present disclosure, self-locking trim ring 106 is a synthetic material. For example, self-locking trim ring 106 may be made of plastic. In an example embodiment, self-locking trim ring 106 may be made of a flexible material to allow for bending of the self-locking trim ring 106 during assembly.

In one aspect of the present disclosure, heath sink 102 is a single block of material such as aluminum, ceramic, plastic, or other material with suitable thermal properties. In another aspect of the present disclosure, heat sink 102 comprises a plurality of components combined to form a single component part.

Figure 2:
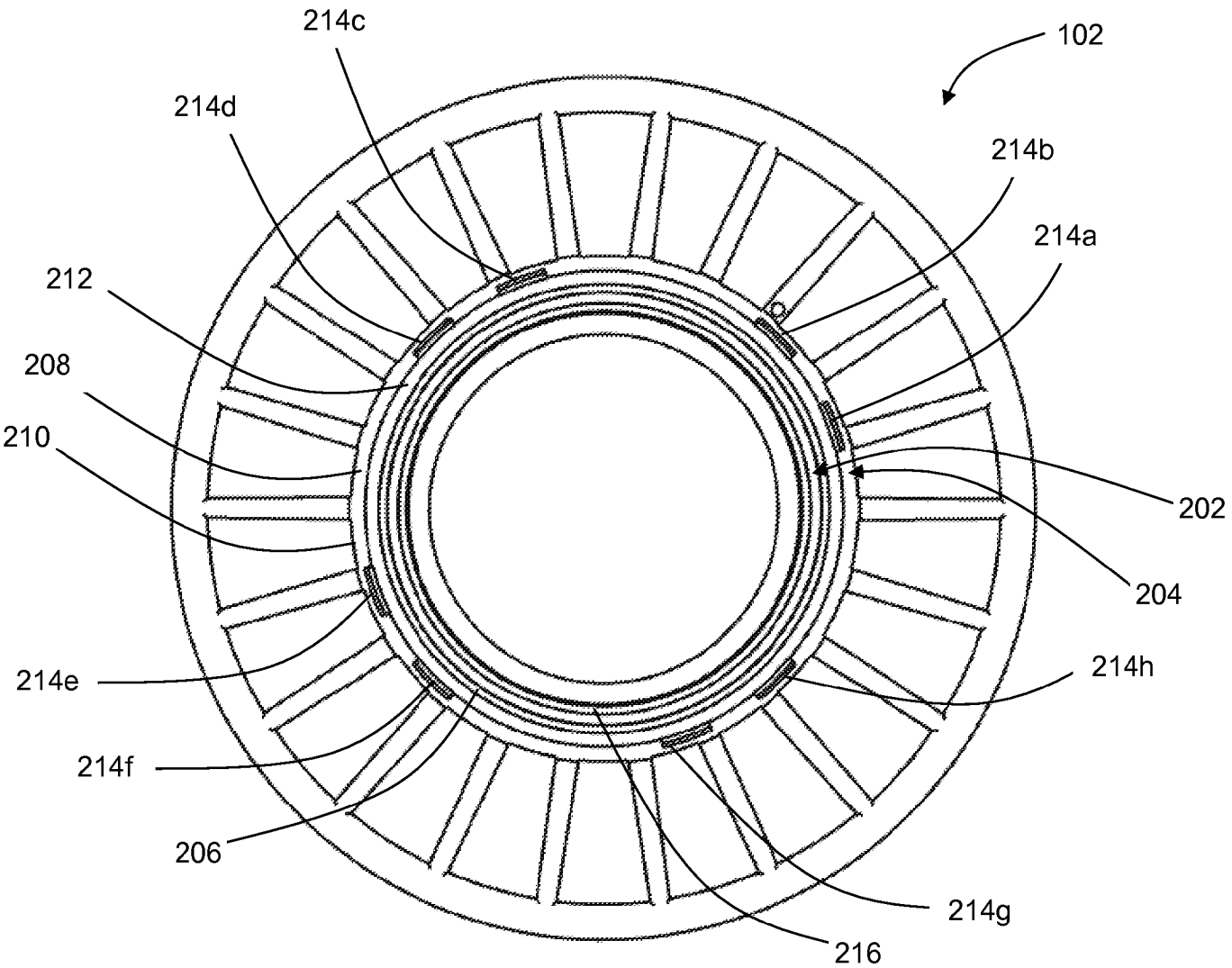
FIG. 2 is a top view of an example heat sink of FIG. 1.

FIG. 2 is a top view of an example heat sink 102 of FIG. 1. Heat sink 102 comprises an inner chamber 202, or channel, configured to receive optical lens 104 and support optical lens 104 from underneath.

In one aspect of the present disclosure, inner chamber 202 comprises an inner groove 216. Inner groove 216 may be configured to receive a sealant. The sealant may be an adhesive such as glue. Alternatively, the sealant may be silicone. Alternatively, the sealant may be a pre-formed gasket or ring. The sealant helps create a bond between optical lens 104 and heat sink 102 to prevent liquids from penetrating. Thus, with the additional inner groove 216 configured to receive a sealant, lamp 100 may be assembled for either a wet application or dry application without modifying lamp 100.

In one aspect of the present disclosure, optical lens 104, illustrated in FIG. 1, has a flange (not shown) protruding from the underside. Inner groove 216 may be configured to receive the flange. Such a flange may provide for a more secure fitting of optical lens 104 with heat sink 102. The flange and inner groove 216 may also provide a guide for an assembler to easily position optical lens 104 in inner chamber 202 when assembling lamp 100.

Heat sink 102 further comprises an outer chamber 204, or channel. Inner chamber 202 and outer chamber 204 are separated by barrier 206. In one aspect of the present disclosure, barrier 206 is configured to surround the perimeter of optic lens 104 to hold optic lens 104 in place to prevent optic lens 104 from shifting within inner chamber 202.

Outer chamber 204 comprises a recess 208. Recess 208 protrudes in from an outer wall 210 of outer chamber 204 and perpendicular to outer wall 210, and partially overlays or covers outer chamber 204. In one aspect of the present disclosure, recess 208 supports self-locking trim ring from underneath.

In one aspect of the present disclosure, recess 208 comprises a plurality of cutouts 214*a-h* or openings (hereinafter referred to as cutouts 214). It should be understood that although FIG. 2 illustrates eight cutouts 214, recess 208 may comprise any number of cutouts 214. In one aspect of the present disclosure, outer chamber 204 further comprises an outer groove 212.

Figure 3:
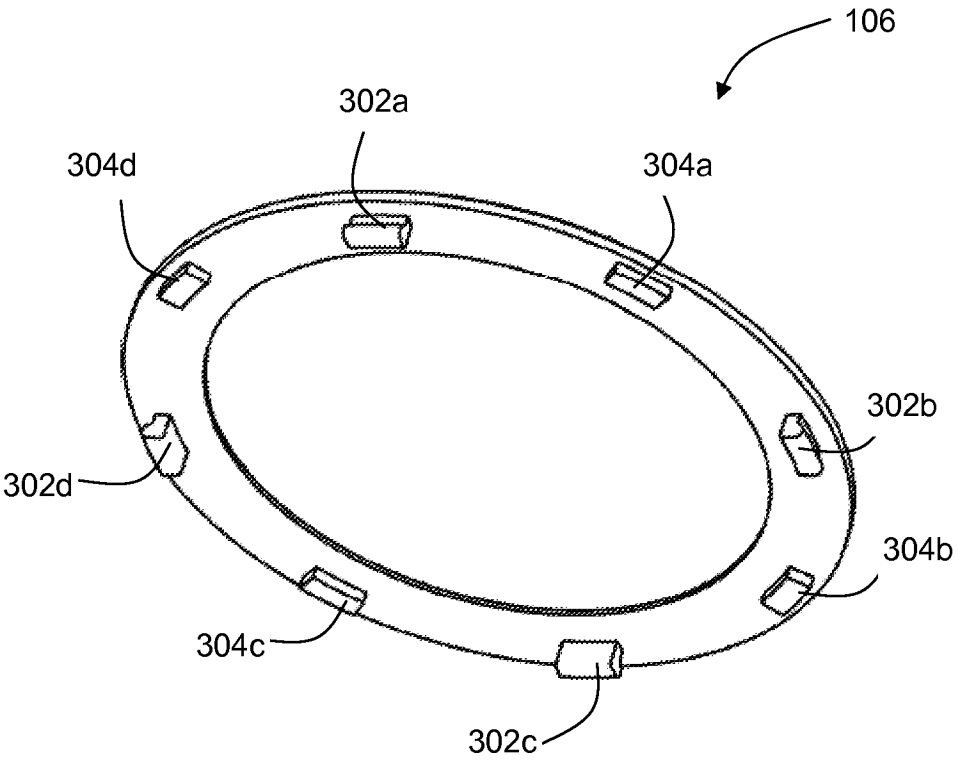
FIG. 3 is a bottom view of an example self-locking trim ring of FIG. 1.

FIG. 3 is a bottom view of an example self-locking trim ring 106 of FIG. 1. Self-locking trim ring 106 has a plurality of teeth 302*a-d* (hereinafter referred to as teeth 302), or ridges having flanks. The teeth 302 extend out from underneath self-locking trim ring 106. Recess 208, illustrated in FIG. 2, is configured to engage the teeth 302, or the flanks of the ridges, of self-locking trim ring 106. In other words, teeth 302 are configured to couple with recess 208 which is configured to hold teeth 302 in place. In one aspect of the present disclosure, outer groove 212, illustrated in FIG. 2, is configured to receive teeth 302 via cutouts 214. It should be understood that although FIG. 3 illustrates self-locking trim ring 106 comprising four teeth 302, self-locking trim ring 106 may comprise any suitable number of teeth.

In one aspect of the present disclosure, self-locking trim ring 106 has a plurality of bosses 304*a-d* (hereinafter referred to as bosses 304), or protruding guides, configured to align with cutouts 214. Bosses 304 sink into cutouts 214 and prevent self-locking trim ring 106 from rotating after assembly is complete. Thus, in one aspect of the present disclosure, the combination of recess 208 engaging teeth 302 of self-locking trim ring 106 and cutouts 214 of recess 208 aligning with bosses 304 of self-locking trim ring 106 result in a permanent lock. In other words, once engaged, self-locking trim ring 106 cannot be removed from heat sink 102 without altering the shape or form of self-locking trim ring 102 by breaking, bending, or cutting self-locking trim ring 106.

It should be understood that, although the figure illustrates four bosses 304, self-locking trim ring 102 may comprise any number of bosses 304.

Referring back to FIG. 1, in one aspect of the present disclosure, self-locking trim ring 106 further includes at least one trim-ring guide mark 108 on the top side, corresponding to one of the teeth 302 illustrated in FIG. 3. Additionally, heat sink 102 further includes at least one heat sink guide mark 110. Trim-ring guide mark 108 and heat sink guide mark 110 provide an assembler with a guide for aligning teeth 302 illustrated in FIG. 3 with cutouts 214 illustrated in FIG. 2, which are not visible to the assembler during an assembly process.

Figure 4:
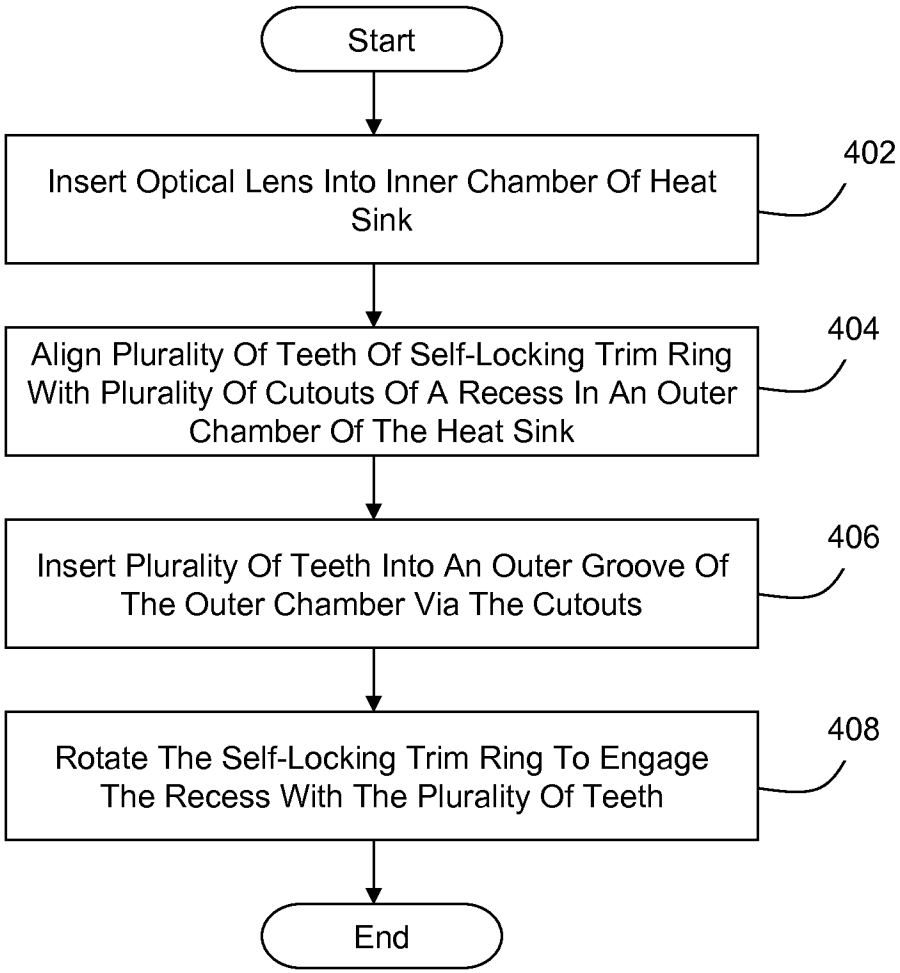
FIG. 4 illustrates an example method for securing an optical lens to a heat sink.

FIG. 4 illustrates an example method for securing optical lens 104 to heat sink 102. At step 402, an assembler, inserts optical lens 104 into inner chamber 202 of heat sink 102. In one aspect of the present disclosure, the assembler inserts optical lens 104 by inserting a flange of optical lens 104 into inner groove 216 of inner chamber 202 of heat sink 102. In one aspect of the present disclosure, the assembler adds a glue, or a sealant, to inner chamber 202 before inserting optical lens 104.

At step 404, the operator aligns teeth 302 of self-locking trim ring 106 with cutouts 214 of recess 208 in outer chamber 204 of heat sink 102. In one aspect of the present disclosure, the operator aligns teeth 302 with cutouts 214 by aligning trim ring guide mark 108 with heat sink guide mark 110.

At step 406, the assembler inserts teeth 302 into outer groove 212 of outer chamber 204 via cutouts 214. At step 408, the assembler rotates self-locking trim ring 106 to engage recess 208 with teeth 302. In one aspect of the present disclosure, the assembler rotates self-locking trim ring 106 until bosses 304 of the self-locking trim ring 106 align with cutouts 214 of recess 208 and sink into cutouts 214. This locks in self-locking trim ring 106 and prevents self-locking trim ring 106 from rotating further. In one aspect of the present disclosure, such rotating permanently locks, or couples, self-locking trim ring 106 with heat sink 102, or permanently engages recess 208 with teeth 302.

In another aspect of the present disclosure, an assembler aligns self-locking trim ring 106 such that one or more teeth 302 align with corresponding cutouts 214 in outer chamber 204. Assembler applies pressure to top of self-locking trim ring 106 at one or more points corresponding to the top side of one or more teeth 302, flexing self-locking trim ring 106 about bosses 304, which do not align with any cutout 214, in order to insert teeth 302 into cutouts to a depth sufficient to parallel the corresponding outer groove 212. While initially maintaining pressure, assembler rotates self-locking trim ring 106, engaging one or more teeth 302 and outer groove 212. Rotation is continued until bosses 304 align with and sink into one or more cutouts 214, releasing the deflection of self-locking trim ring 106, halting rotation of the self-locking trim ring 106, and locking self-locking trim ring 106 into place. Accordingly, in one aspect of the present disclosure, self-locking trim ring 106 is made of a flexible material.

In one aspect of the present disclosure, an assembler flexes or bends self-locking trim ring 106 while simultaneously applying pressure to the top of self-locking trim ring 106, at one or more points corresponding to the top side of one or more teeth 302, in order to insert teeth 302 into outer groove 212. In one aspect of the present disclosure, the installer maintains self-locking trim ring 106 in a flexed position and also maintains pressure on the top of self-locking trim ring while rotating self-locking trim ring 106 until bosses 304 align with and sink into cutouts 214. Once bosses 304 align with and sink into cutouts 214, assembler releases the pressure being applied to self-locking trim ring 106 which allows self-locking trim ring 106 to straighten from its flexed position and lock into place. Accordingly, in one aspect of the present disclosure, self-locking trim ring 106 is made of a flexible material.

Figure 5:
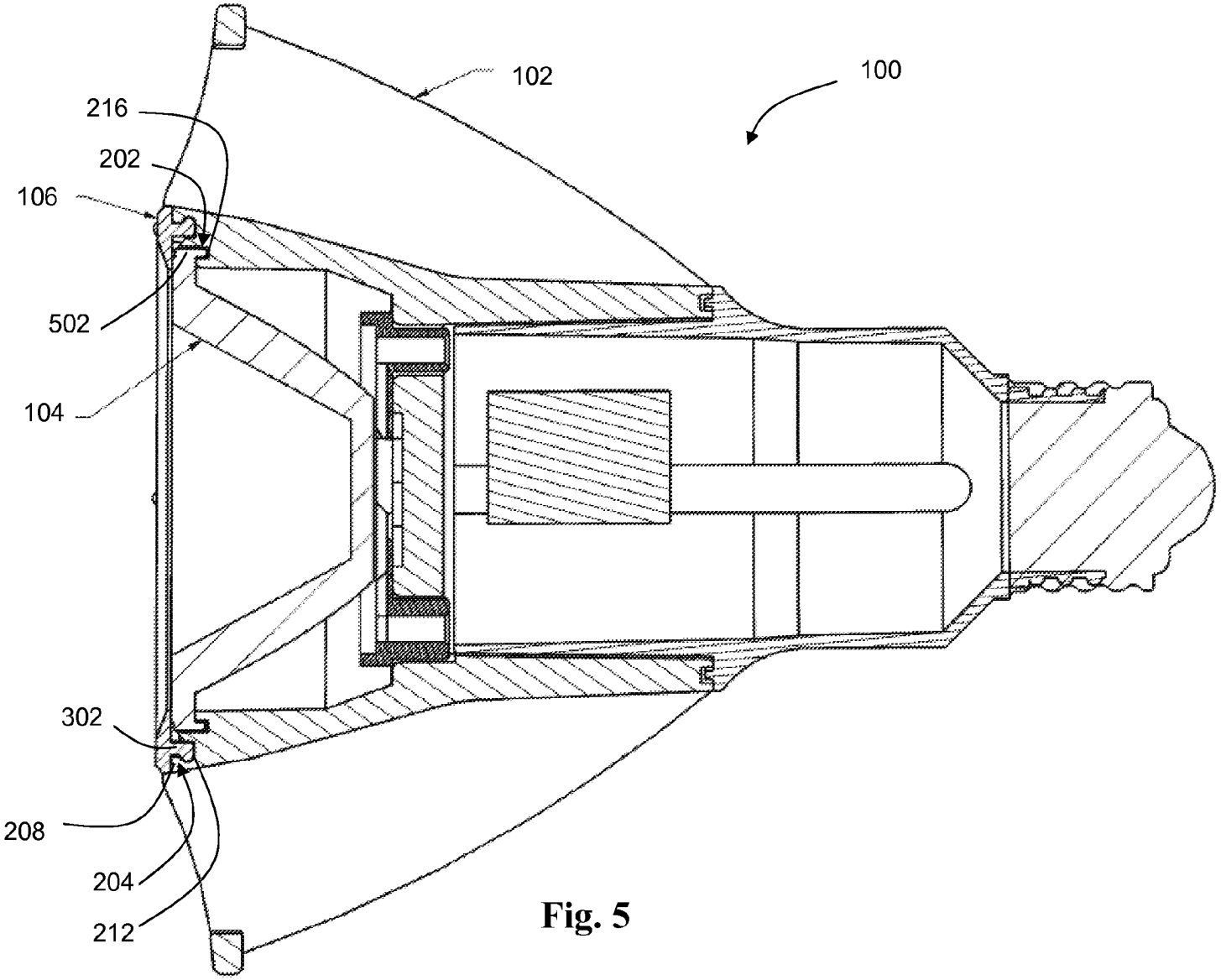
FIG. 5 is a cross-sectional side view of the example lamp of FIG. 1.

FIG. 5 is a cross-sectional side view of lamp 100 of FIG. 1 after self-locking trim ring 106 has been inserted to secure optical lens 104 to heat sink 102, according to the method described in FIG. 4. Heat sink 102 has inner chamber 202 with inner groove 216 for receiving flange 502 of optical lens

104. Heat sink 102 also has outer chamber 204 with outer groove 212 for receiving teeth 302 of self-locking trim ring 106. Outer chamber 204 also has recess 208 for engaging teeth 302.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application has been illustrated by the description of example aspects of the present disclosure thereof, and while the example aspects have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, the representative apparatus and method, and illustrative examples shown and described. Accordingly, departures may be made from such details without departing from the spirit or scope of the applicant's general inventive concept.

What is claimed is:

1. A lamp comprising:
an optical lens;
a self-locking trim ring including a plurality of teeth, the self-locking trim ring disposed over the optical lens; and
a heat sink including:
an inner chamber, wherein the optical lens is disposed in the inner chamber; and
an outer chamber disposed radially outwardly from the inner chamber, the outer chamber having a recess that engages the plurality of teeth;
wherein the self-locking trim ring secures the optical lens to the heat sink.

2. The apparatus of claim 1, wherein:
the recess comprises a plurality of cutouts; and
the outer chamber further comprises a groove, wherein the groove receives the plurality of teeth through the cutouts.

3. The apparatus of claim 2, wherein the self-locking trim ring further comprises a plurality of bosses that align with the plurality of cutouts and prevent the self-locking trim ring from rotating.

4. The apparatus of claim 1, wherein the optic lens comprises a flange and wherein the inner chamber comprises an inner groove that receives the flange.

5. The apparatus of claim 1, wherein the inner chamber comprises an inner groove that receives an adhesive.

6. The apparatus of claim 1, wherein the self-locking trim ring is plastic.

7. The apparatus of claim 1, wherein the self-locking trim ring is permanently locking.

8. A lamp comprising:
an optical lens;
a self-locking trim ring comprising a plurality of ridges having flanks; and
a lens housing comprising:
an inner channel for supporting the optical lens;
a sealant disposed within the inner channel, the sealant creating a bond between the lens housing and the optical lens;
an outer channel comprising a recess for engaging the flanks of the plurality of ridges; and
a barrier for separating the inner channel and the outer channel, the barrier holding the optic lens in place and preventing the optic lens from shifting within the inner chamber;
wherein the self-locking trim ring secures the optical lens to the lens housing.

9. The lamp of claim 8, wherein:
the recess comprises a plurality of openings and the outer channel is for receiving the plurality of ridges via the openings.

10. The lamp of claim 9, wherein the self-locking trim ring further comprises a plurality of protruding guides for aligning with the plurality of openings to prevent the self-locking trim ring from rotating.

11. The lamp of claim 8, wherein the inner channel is for receiving the optical lens comprising of a flange.

12. The lamp of claim 8, wherein the self-locking trim ring is synthetic.

13. The lamp of claim 8, wherein the self-locking trim ring permanently secures the optical lens to the lens housing.

14. A method for securing an optical lens to a heat sink of a lamp, comprising the steps of:
inserting the optical lens into an inner chamber of the heat sink of the lamp;
aligning a plurality of teeth of a self-locking trim ring with a plurality of cutouts of a recess in an outer chamber of the heat sink;
inserting the teeth into a groove in the outer chamber, through the cutouts;
and
rotating the self-locking trim ring to engage the recess with the plurality of teeth.

15. The method of claim 14, further comprising the step of permanently coupling the recess with the plurality of teeth by rotating the self-locking trim ring until a plurality of bosses of the self-locking trim ring align with the plurality of cutouts to prevent the self-locking trim ring from further rotating.

16. The method of claim 14, further comprising the step of rotating the self-locking trim ring until a plurality of bosses of the self-locking trim ring align with the plurality of cutouts to prevent the self-locking trim ring from further rotating.

17. The method of claim 14, further comprising the step of inserting a sealant into a groove of the inner chamber prior to inserting the optical lens into the inner chamber.

18. The method of claim 14, wherein the step of inserting an optical lens into an inner chamber of a heat sink comprises inserting a flange of the optical lens into a groove of the inner chamber.

19. The method of claim 14, wherein the step of aligning a plurality of teeth of a self-locking trim ring with a plurality of cutouts of a recess in an outer chamber of the heat sink comprises aligning a trim ring guide mark with a heat sink guide mark.

* * * * *